US006863120B2

(12) United States Patent
Hwang et al.

(10) Patent No.: US 6,863,120 B2
(45) Date of Patent: Mar. 8, 2005

(54) LAMINATED HEAT EXCHANGER

(75) Inventors: Sunjong Hwang, Daejeon (KR); Guiyoun Hwang, Daejeon (KR); Duksu Kim, Daejeon (KR)

(73) Assignee: Halla Climate Control Corporation, Daejeon-si (KR)

( * ) Notice: Subject to any disclaimer, the term of this patent is extended or adjusted under 35 U.S.C. 154(b) by 0 days.

(21) Appl. No.: 10/747,839

(22) Filed: Dec. 29, 2003

(65) Prior Publication Data

US 2004/0144524 A1 Jul. 29, 2004

(30) Foreign Application Priority Data

Dec. 30, 2002 (KR) ..... 2002-86956
May 23, 2003 (KR) ..... 2003-32832

(51) Int. Cl.[7] ..... F28O 1/03
(52) U.S. Cl. ..... 165/153; 165/174
(58) Field of Search ..... 165/148–176

(56) References Cited

U.S. PATENT DOCUMENTS 4,600,053 A * 7/1986 Patel et al. ..... 165/170
5,855,240 A * 1/1999 Farrell et al. ..... 165/76
5,881,805 A * 3/1999 Inoue et al. ..... 165/153
6,082,449 A * 7/2000 Yamaguchi et al. ..... 165/167
6,095,239 A * 8/2000 Makino et al. ..... 165/140
6,170,565 B1 * 1/2001 Nishishita ..... 165/140
6,173,764 B1 * 1/2001 Inoue ..... 165/153

FOREIGN PATENT DOCUMENTS

KR 1020000062444 10/2000

* cited by examiner

*Primary Examiner*—Paul J. Hirsch
(74) *Attorney, Agent, or Firm*—Bachman & LaPointe, P.C.

(57) ABSTRACT

This invention relates to a laminated heat exchanger, more particularly, which is constructed to close some of distribution channels in refrigerant distributing sections of tubes to uniformly distribute refrigerant into the tubes thereby improving refrigerant flow distribution. The laminated heat exchanger comprises a number of laminated tubes, a refrigerant inlet pipe, a refrigerant outlet pipe, a number of heat radiator fins and at least one of the tubes includes a pair of tanks, a refrigerant flow section for connecting the tanks via a partitioning bead formed between the tanks, refrigerant distribution sections provided at inlet and outlet sides of the refrigerant flow section and each having a plurality of distribution channels partitioned by at least one bead, and channel-restricting means provided in each of the refrigerant distribution sections, for restricting two outermost ones of the distribution channels.

10 Claims, 13 Drawing Sheets

Prior Art

Prior Art

Prior Art

Prior Art

Prior Art

Prior Art

PRIOR ART

INVENTION

LAMINATED HEAT EXCHANGER

BACKGROUND OF THE INVENTION

1. Field of the Invention

The present invention relates to a laminated heat exchanger, more particularly, which is constructed to close some of distribution channels in refrigerant distributing sections of tubes to uniformly distribute refrigerant into the tubes thereby improving flow distribution of refrigerant.

2. Background of the Related Art

A heat exchanger comprises internal flow channels so that refrigerant flows through the same while performing heat exchange with external air, and is applied to various air conditioning systems. Examples of the heat exchanger may include a fin tube type, a serpentine type, a drawn cup type and a parallel flow type which are used according to various conditions.

Hereinafter an evaporator of the heat exchangers using refrigerant as heat exchange medium will be described as an example.

As shown in FIGS. 1 to 6, the evaporator 1 comprises a pair of tanks 40*a* each having cups 14 with slots 14*a* formed at upper ends (or lower ends) thereof, a plurality of tubes 10 each having a refrigerant flow section 12 of a generally U-shaped configuration, which is formed by welding two plates 11 with a partitioning bead 13 extended to a predetermined length between a pair of tanks 40*a* and tanks 40 formed at both sides by the welded tanks 40*a*, heat radiator fins 50 laminated or stacked between the respective tubes 10 and two end plates 30 installed at outermost sides to reinforce the tubes 10 and the heat radiator fins 50.

In a pair of the plates 11 coupled to face each other, a number of beads 15 which are projected inward via embossment in order to impart turbulence to refrigerant flowing through the refrigerant flowing sections 12 of the tubes 10.

The opposing plates 11 on both sides are coupled to each other with a number of beads, 15 formed by embossing treatment, protruding inward, in order to make refrigerant flowing within the refrigerant flow sections 12 of the tubes 10 become turbulent.

Furthermore, refrigerant distribution sections 16 are provided at the inlet and outlet sides of the refrigerant flow sections 12 of the tubes 10, having a plurality of distribution channels 16*b* partitioned by a plurality of beads 16*a* for refrigerant uniform distribution into the refrigerant flow sections 12.

Meanwhile, two tank-type and four tank-type plates are identical except that an additional cup is provided at the bottom end. Therefore, only a plate 11 having a cup 14 formed at the upper end is given as an example, for clarity of explanation.

The tubes 10 are also provided with inlet side manifolds 17 protruding toward a side of the tanks 40 for communication with the inside and connected with inlet pipes 2 for refrigerant supply, as well as outlet side manifolds 17*a* connected with outlet pipes 3 for refrigerant discharge.

The manifolds 17, 17*a* are formed in the form of a circular pipe by coupling two plates having semicircular manifolds 17, 17*a*. The resulting manifolds 17, 17*a* are united with the inlet and outlet pipes 2, 3 by means of brazing material of a ring shape and brazed, thereby making it possible to couple the manifolds 17, 17*a* with the inlet and outlet pipes 2, 3.

Regarding refrigerant flow within the evaporator 1 configured as above, the tanks 40, having inlet side and outlet side manifolds 17, 17*a* formed for refrigerant, are provided with baffles 60 therein for partitioning between inflow refrigerant and discharged refrigerant.

Accordingly, the pair of tanks 40 are divided into inlet side 4 for inflow refrigerant and outlet side 5 for discharged refrigerant, from the standpoint of the baffles 60. Suppose that the tank 40 on the inlet side 4 is referred to as A, B and the tank 40 on the outlet side 5 is referred to as C, D in the drawings. Refrigerant supplied through the inlet side manifold 17 is then supplied to the A side of the tank 40, flows along the U-shaped refrigerant flow section 12 and finally directed into the B side of the adjacent tank 40 on the other side.

Refrigerant directed into the B side of the tank 40 flows to the C side of the same tank 40 and flows along the U-shaped refrigerant flow section 12 of the tubes 10. When refrigerant flows into the D side of the tank 40, it is finally discharged through the outlet side manifold 17*a*.

In the process of causing inflow and discharge of refrigerant circulating in a cooling system through refrigerant lines, the evaporator 1 conducts evaporation through heat exchange with the air blown between the tubes 10. The endothermic action, due to the latent heat of evaporation of refrigerant, then cools the airblown to the inside of the vehicle room.

When refrigerant flows into the inlet side manifold 17, refrigerant is supposed to be distributed uniformly to both ends of the tank A side and flow to each of the tubes 10, as shown in FIG. 1. However, as the flow rate of refrigerant flowing directly into the refrigerant flow section 12 of the tube 10*a* having the manifold 17 formed increases, uniform distribution to both ends of the A side of the tank 40 is not guaranteed. This causes irregular distribution of refrigerant flowing in the tubes 10.

According to the type of installation of the evaporator 1 in the air-conditioning device of a vehicle, a top tank-type, wherein the tank 40 faces upward, and a bottom tank-type, wherein the tank 40 faces downwards, are utilized, as shown in FIG. 5. In case of the top tank-type, refrigerant is mainly subject to gravity when it flows in through the manifold 17 and is subject to an inertial force when it makes a U-turn through the refrigerant flow section 12, thereby flowing along the outer shell of the refrigerant flow section 12 of the tube 10*a* having manifolds formed.

In case of the bottom tank-type, refrigerant is subject to an inertial force when it flows in through the manifold 17 and is mainly subject to a gravity when it makes a U-turn through the refrigerant flow section 12, thereby flowing near the partitioning bead 13.

Such uneven flow of refrigerant causes poor flow distribution of refrigerant in the refrigerant flow section 12 of the tube 10*a* having the manifold 17 formed and uneven heat exchange with the air passing between the tubes 10, 10*a*. This leads to considerable fluctuation in the temperature distribution of the discharged air. Consequently, the performance of the air-conditioning system becomes unstable.

Furthermore, more refrigerant flows to the tube 10 adjoining the tube 10*a* having the manifold 17 formed while lesser refrigerant flows nearer to both ends. This causes a supercooled area and an over-heated area. Even an icing problem occurs on the surface of the evaporator 1 in the supercooled area.

An approach to solve the above-mentioned problem is described, as an embodiment, in a registered Korea patent No. 352,876 issued to the assignee of the invention, entitled "*Plate for Heat Exchanger Having Enhanced Evaporating*

*Performance and Heat Exchanger Using It*", the whole contents thereof are incorporated herein for reference. It will now be explained briefly with reference to FIG. 6.

The refrigerant distribution section, 16 formed at the inlet and outlet sides of the refrigerant flow section 12 of the tube 10*a* having the manifold 17, is provided with a plurality of distribution channels 16*b* partitioned by a plurality of beads 16*a*, as shown in the drawing.

The inlet side refrigerant distribution section 16 of the refrigerant flow section 12 adjoining the manifold 17 is formed in such a manner that two outermost distribution channels are interrupted.

Accordingly, cooling effect is increased by improving the flow distribution of refrigerant, which is a problem of the prior art, to a degree.

When refrigerant flows into the inlet side manifold 17, the flow rate of refrigerant flowing directly to the refrigerant flow section 12 through the refrigerant distribution section 16 of the tube 10*a* is small. As a result, refrigerant is distributed uniformly to both ends of tank A side shown in FIG. 1 and flows toward each of the tank 10.

At the same time, any uneven flow of refrigerant into the refrigerant flow section 12 is prevented, during inflow of refrigerant into the manifold 17.

Although any uneven flow of refrigerant into the refrigerant flow section 12 can be prevented by interrupting the two outermost distribution channels at the inlet side refrigerant distribution section 16 of the refrigerant flow section 12, the approach still has a problem in that the outlet side refrigerant distribution section 16 of the refrigerant flow section 12 has the same structure as in the prior art, that is, has no interrupted distribution channels. As a result, refrigerant still flows uneven and the effect of flow distribution of refrigerant is unreliable.

Meanwhile, from the standpoint of the baffle 60, refrigerant undergoes heat exchange while passing through the inlet side tubes 4 and then flows toward the outlet side 5. In other words, refrigerant flows from tank 40 B side of the inlet side 4 to the tank 40 C side of the outlet side 5.

When the refrigerant flows from the B side of the tank 40 to the C side of the same tank 40, it is supposed to be distributed uniformly and flow into the tubes 10, 10*a* positioned at the C side. However, the refrigerant flowing from the B side tank 40 to the C side tank 40 is mainly subject to a gravity. Accordingly, as the refrigerant approaches the end of the C side tank 40, the amount of refrigerant flowing into each of the tubes 10, 10*a* decreases. This results in the problem that the refrigerant is not distributed uniformly to each of the tubes 10, 10*a*.

Therefore, considerable fluctuation occurs in the surface temperature at the outlet surface of the evaporator 1 and this becomes worse when less refrigerant flows or less air passes through the evaporator 1.

Furthermore, a supercooled area is formed in the tube 10 having more refrigerant flow and an over-heated area is formed in the tube having lesser refrigerant flow. This causes poor heat exchange with the air passing between the tubes 10. As a result, considerable fluctuation occurs in the temperature distribution of the discharged air.

Even an icing problem occurs on the surface of the evaporator 1 in the supercooled area, thereby making the air-conditioning system unstable. In the over-heated area, cooling and dehumidification of discharged air is not conducted properly. This result in the problem in that humid air of elevated temperature is introduced into the vehicle room and irritates the passengers.

SUMMARY OF THE INVENTION

The present invention has been made to solve the foregoing problems and it is therefore an object of the present invention to provide a laminated heat exchanger in which two outermost distribution channels of refrigerant distribution sections in inlet and outlet sides of refrigerant flow sections are closed in order to uniformly distribute and introduced refrigerant into the tanks as well as prevent any lopsided flow of refrigerant thereby improving refrigerant flow distribution and causing outlet surface temperature and outlet air temperature to be uniform, whereby refrigerant is uniformly distributed and introduced into tubes so as to prevent any problems related with a supercooled or over-heated area and icing.

According to an aspect of the invention for realizing the above object, there is provided a laminated heat exchanger comprising: a number of laminated tubes and each formed by coupling a pair of plates; a refrigerant inlet pipe for feeding refrigerant to the tubes; a refrigerant outlet pipe for discharging refrigerant out of the tubes; and a number of heat radiator fins interposed between the tubes, wherein at least one of the tubes includes: a pair of tanks; a refrigerant flow section for connecting the tanks via a partitioning bead formed between the tanks; refrigerant distribution sections provided at inlet and outlet sides of the refrigerant flow section and each having a plurality of distribution channels partitioned by at least one bead; and channel-restricting means provided in each of the refrigerant distribution sections, for restricting two outermost ones of the distribution channels.

According to another aspect of the invention for realizing the above objects, there is provided a laminated heat exchanger comprising: a number of laminated tubes and each formed by coupling a pair of plates; a refrigerant inlet pipe for feeding refrigerant to the tubes; a refrigerant outlet pipe for discharging refrigerant out of the tubes; and a number of heat radiator fins interposed between the tubes, wherein at least one of the tubes includes: a pair of tanks; a refrigerant flow section for connecting the tanks via a partitioning bead formed between the tanks; and refrigerant distribution sections provided at inlet and outlet sides of the refrigerant flow section and having distribution channels formed in a lateral intermediate portion of the refrigerant flow section by channel-restricting sections.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter the present invention will be described in detail with reference to the appended drawings, in which explanation to components same as those in the prior art will be omitted.

Figure 1:
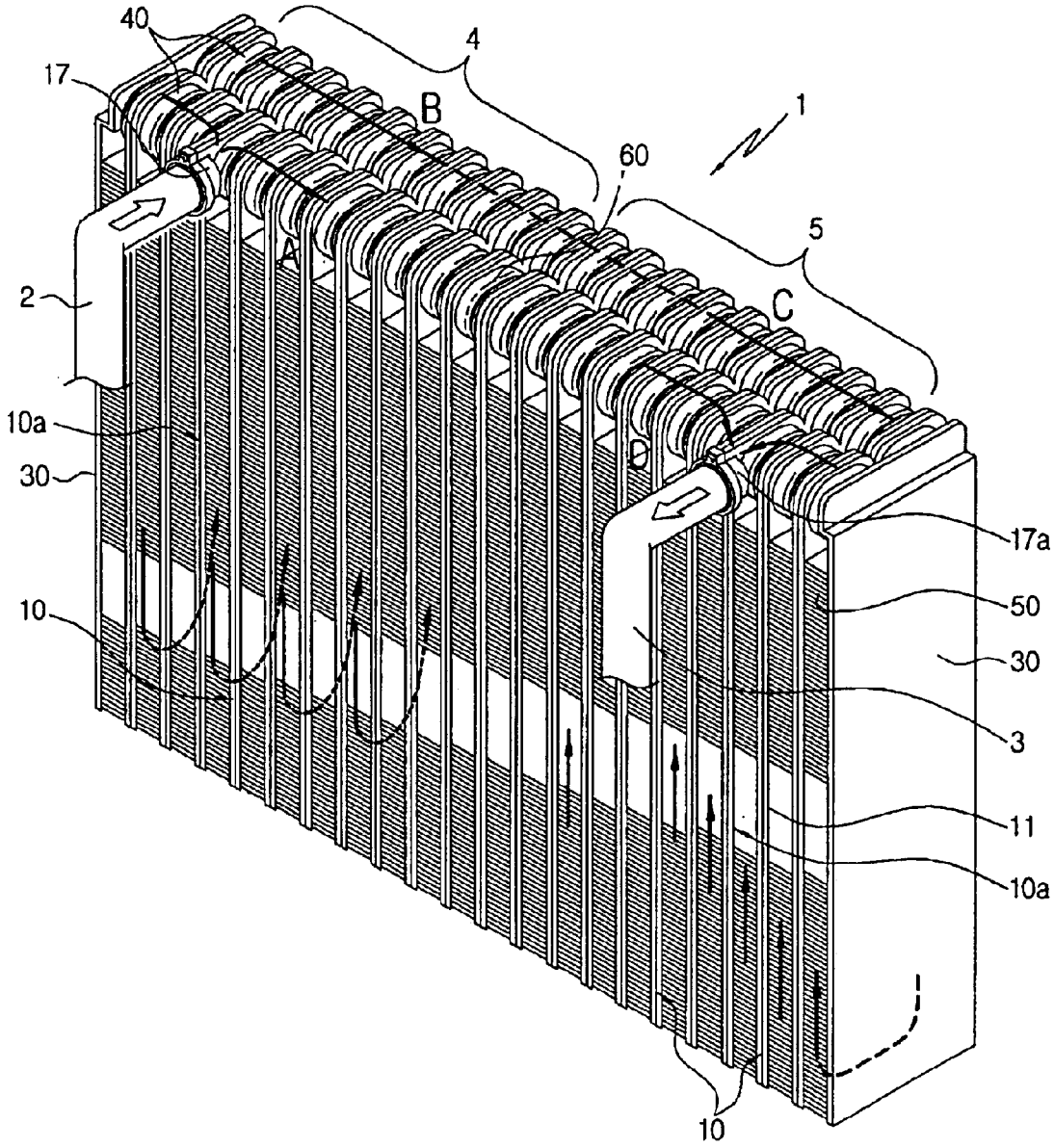
FIG. 1 is a perspective view illustrating an evaporator in a conventional heat exchanger.
Figure 2:
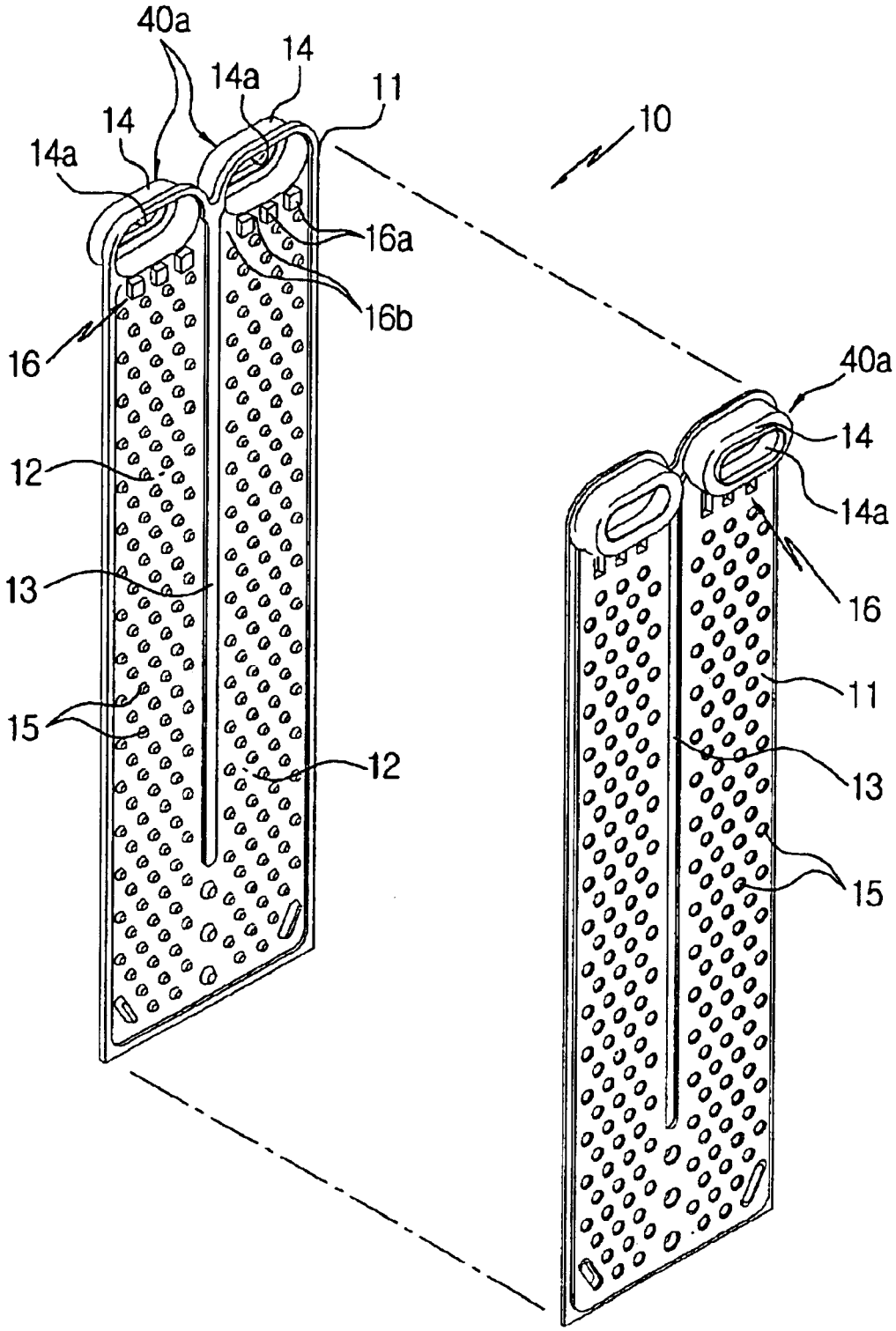
FIG. 2 is a perspective view illustrating tubes separated from a conventional evaporator.
Figure 3:
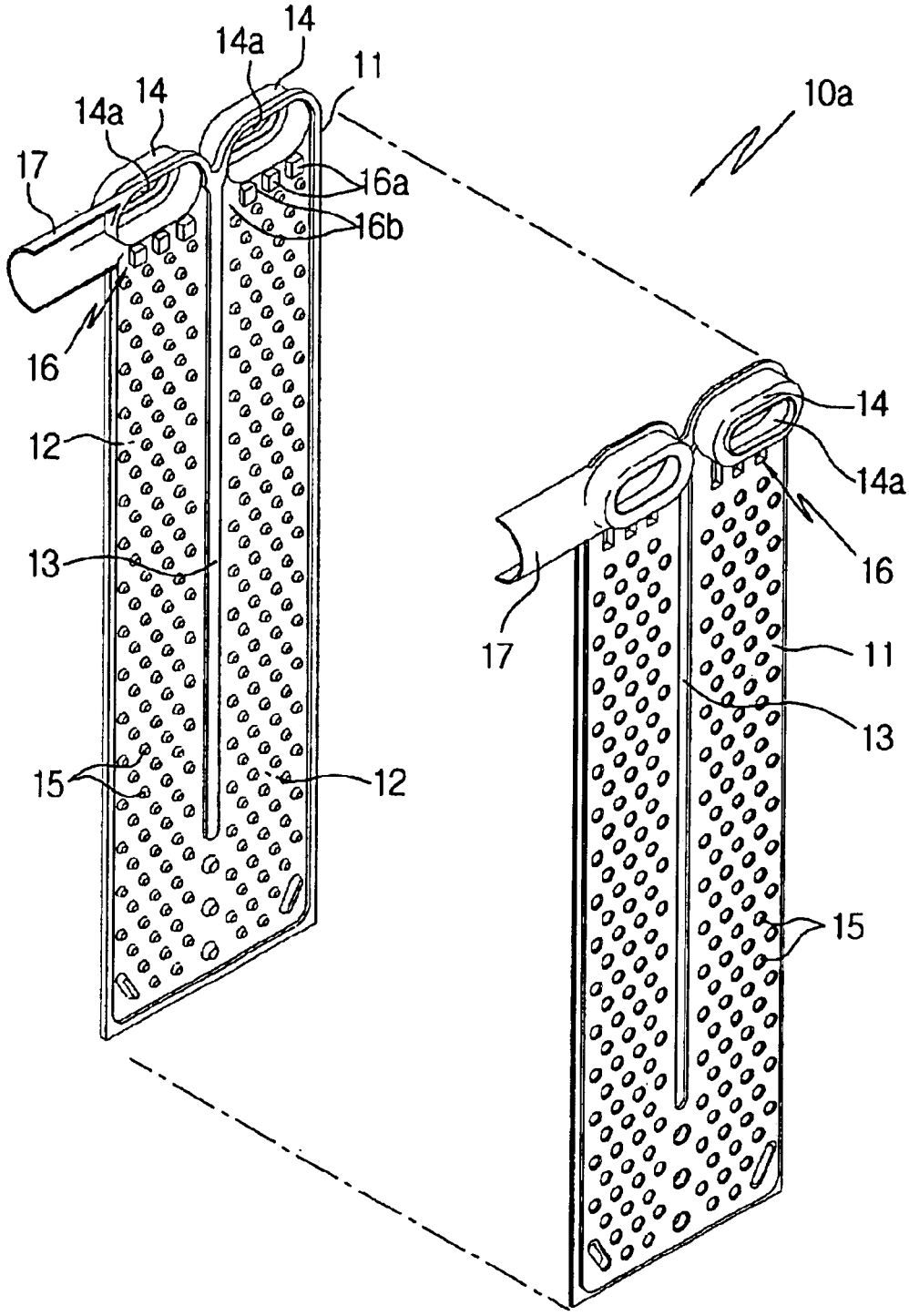
FIG. 3 is a perspective view illustrating tubes with manifolds separated from a conventional evaporator.
Figure 4:
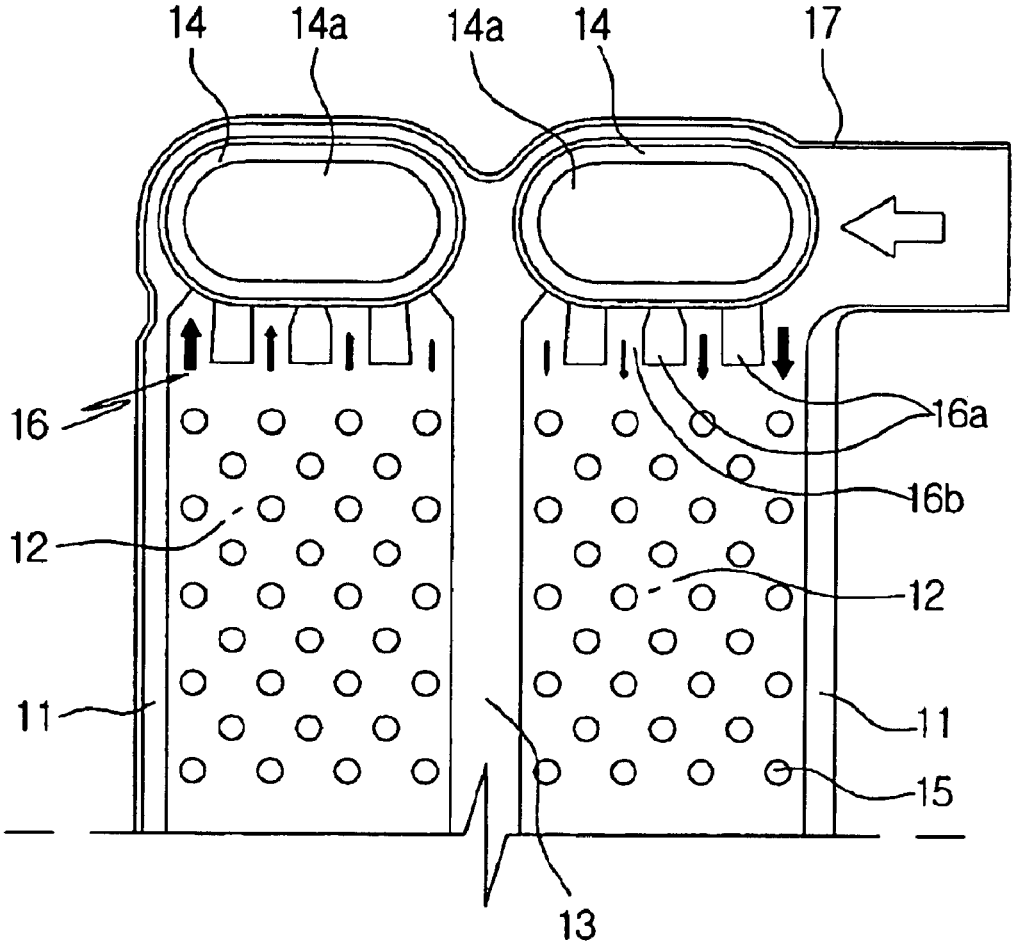
FIG. 4 is a front view illustrating a plate of a tube provided with manifolds in a conventional evaporator.
Figure 5:
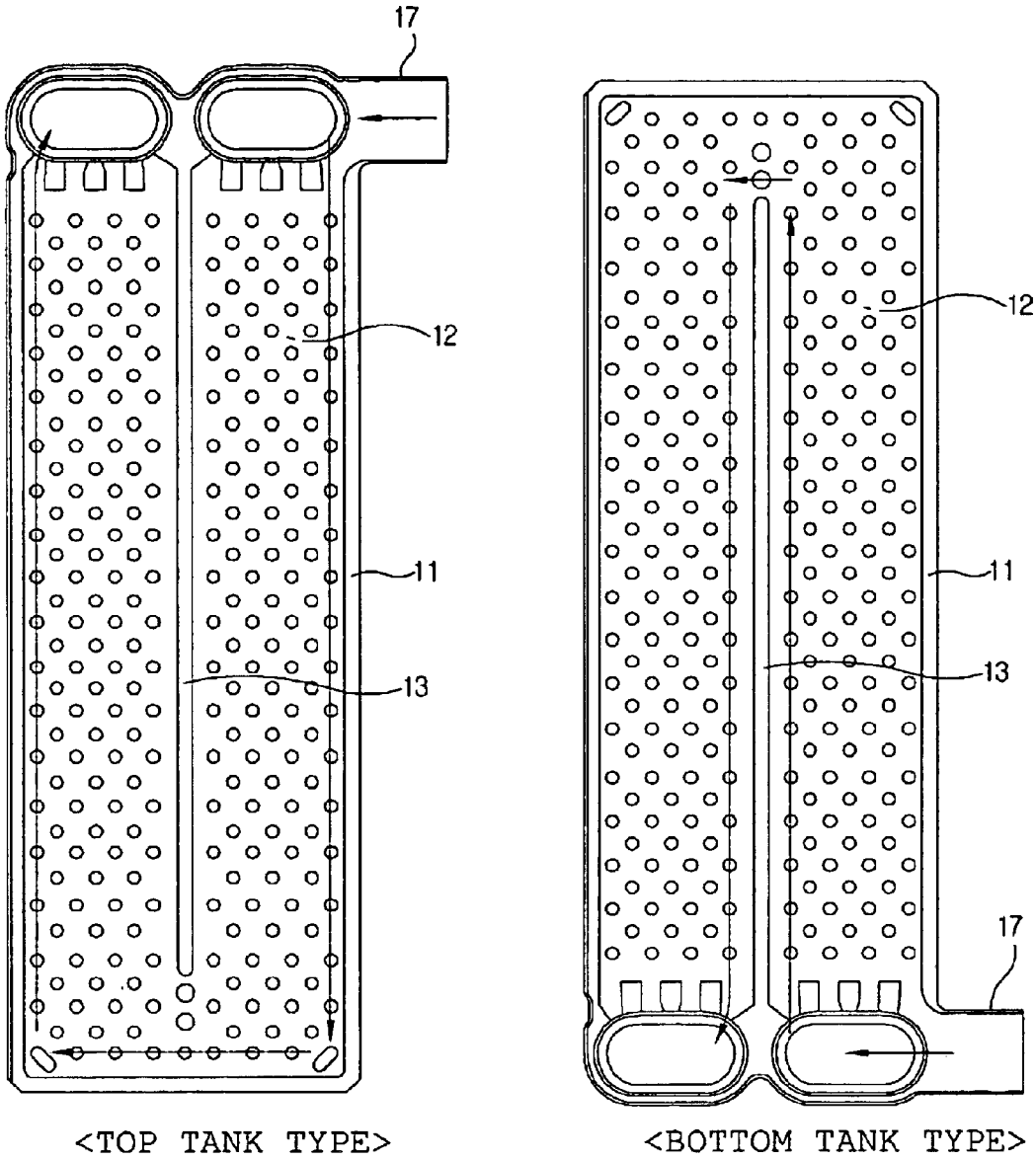
FIG. 5 illustrates conventional top and bottom mounting type tubes each provided with manifolds in which lopsided refrigerant flow is created.
Figure 6:
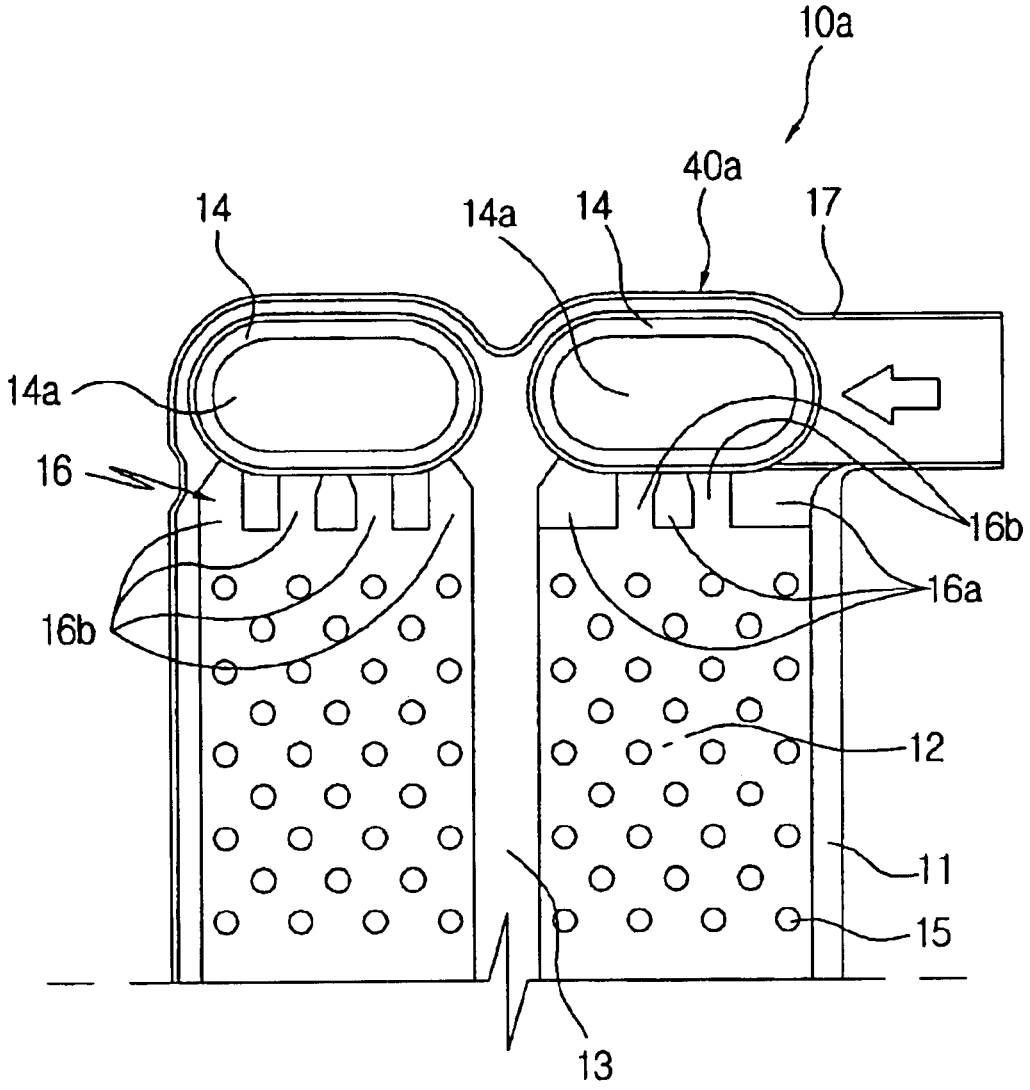
FIG. 6 illustrates a tube with a manifold in which two outermost distribution channels of an inlet side refrigerant distribution section are closed.
Figure 7:
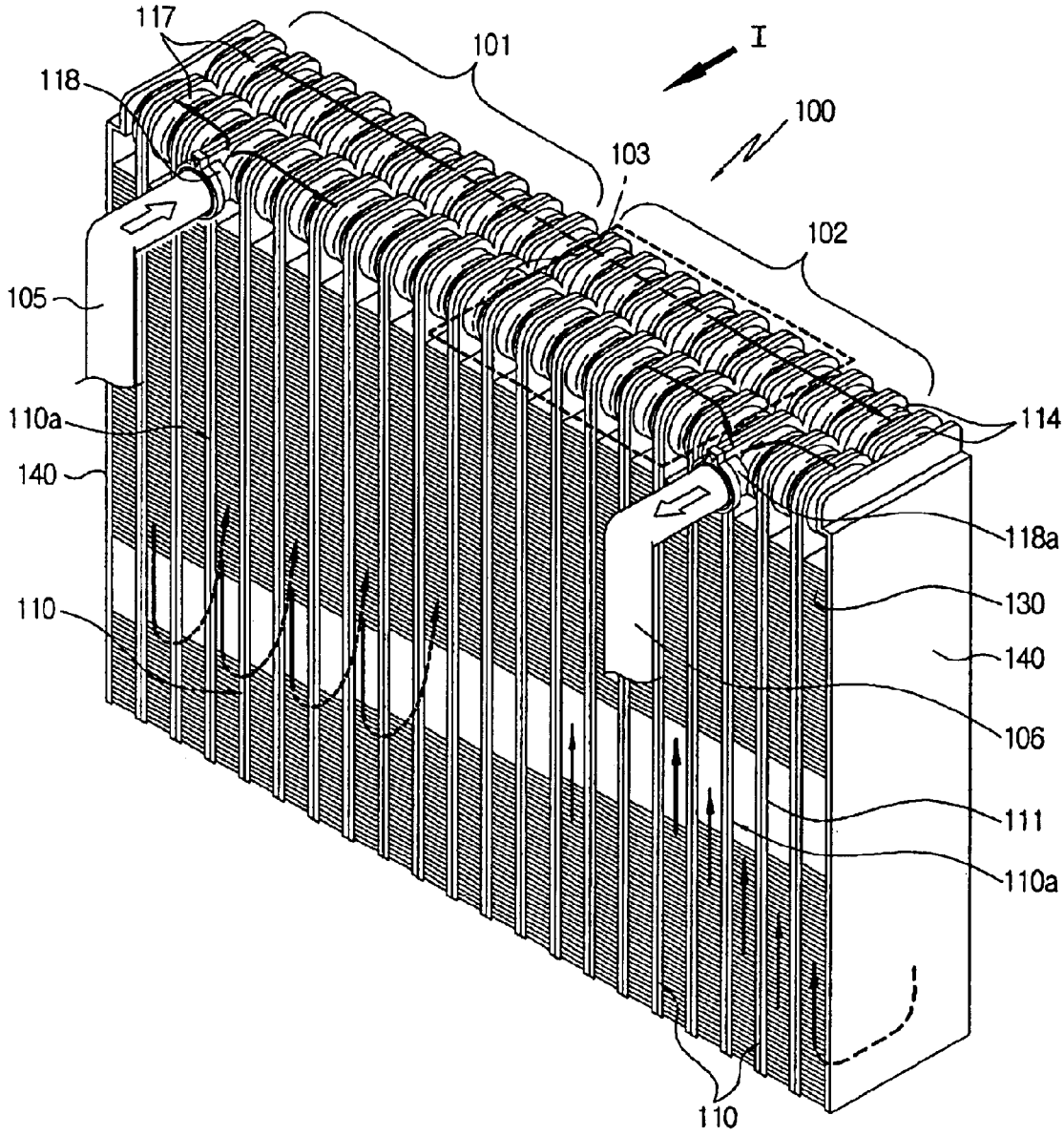
FIG. 7 is a perspective view illustrating an evaporator of the invention.
Figure 8:
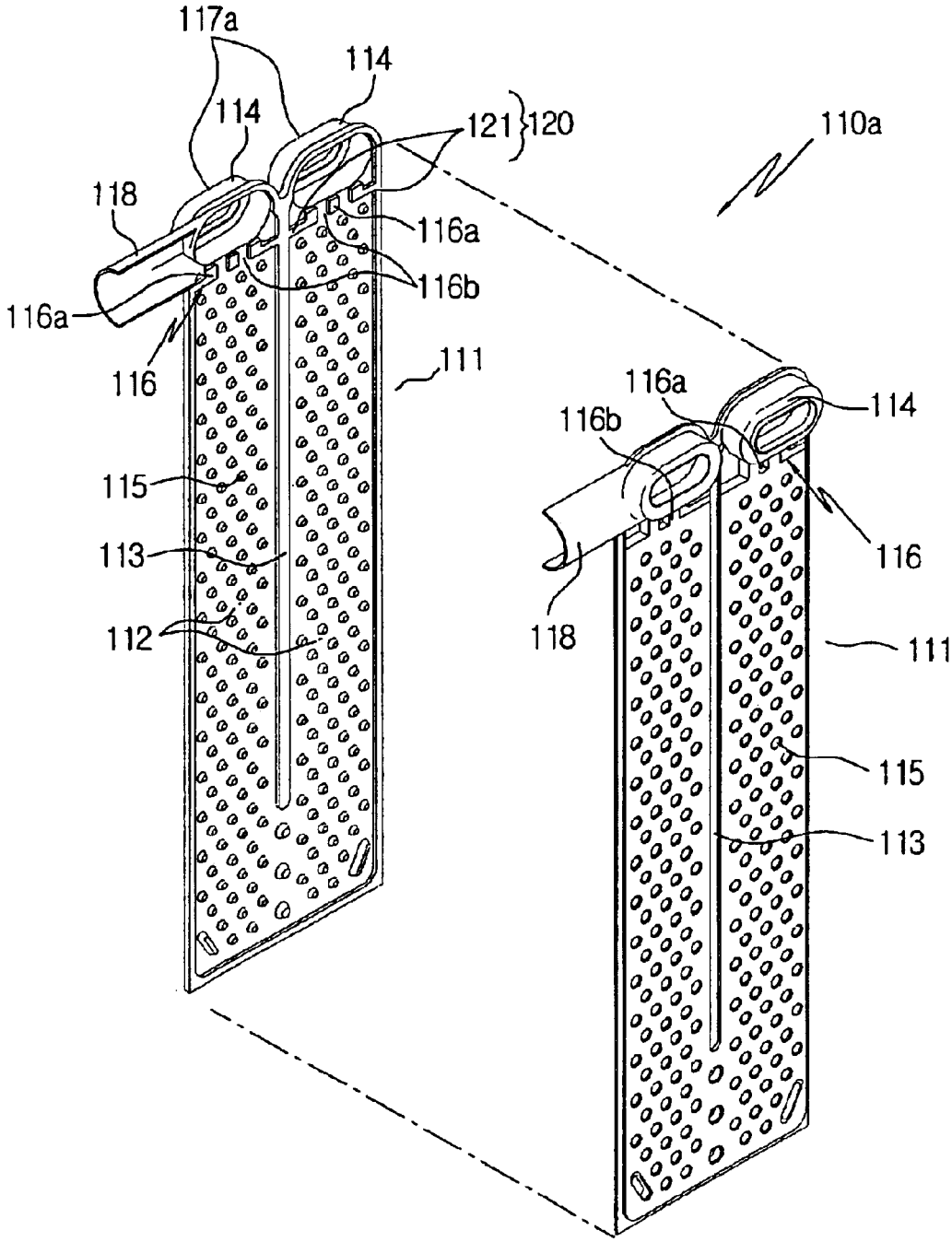
FIG. 8 is a perspective view illustrating separated tubes with manifolds of the invention.
Figure 9:
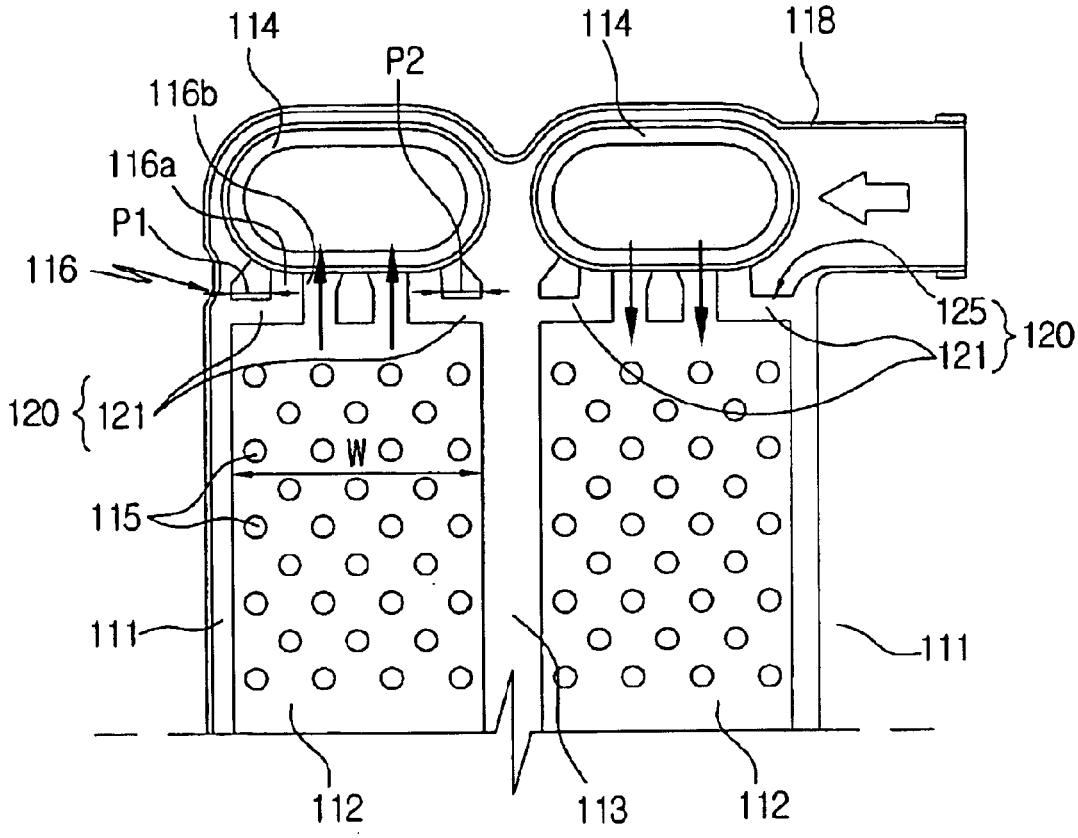
FIG. 9 illustrates a tube with a manifold of the invention, in which two outermost distribution channels of inlet and outlet side refrigerant distribution sections are closed with closure beads.
Figure 10:
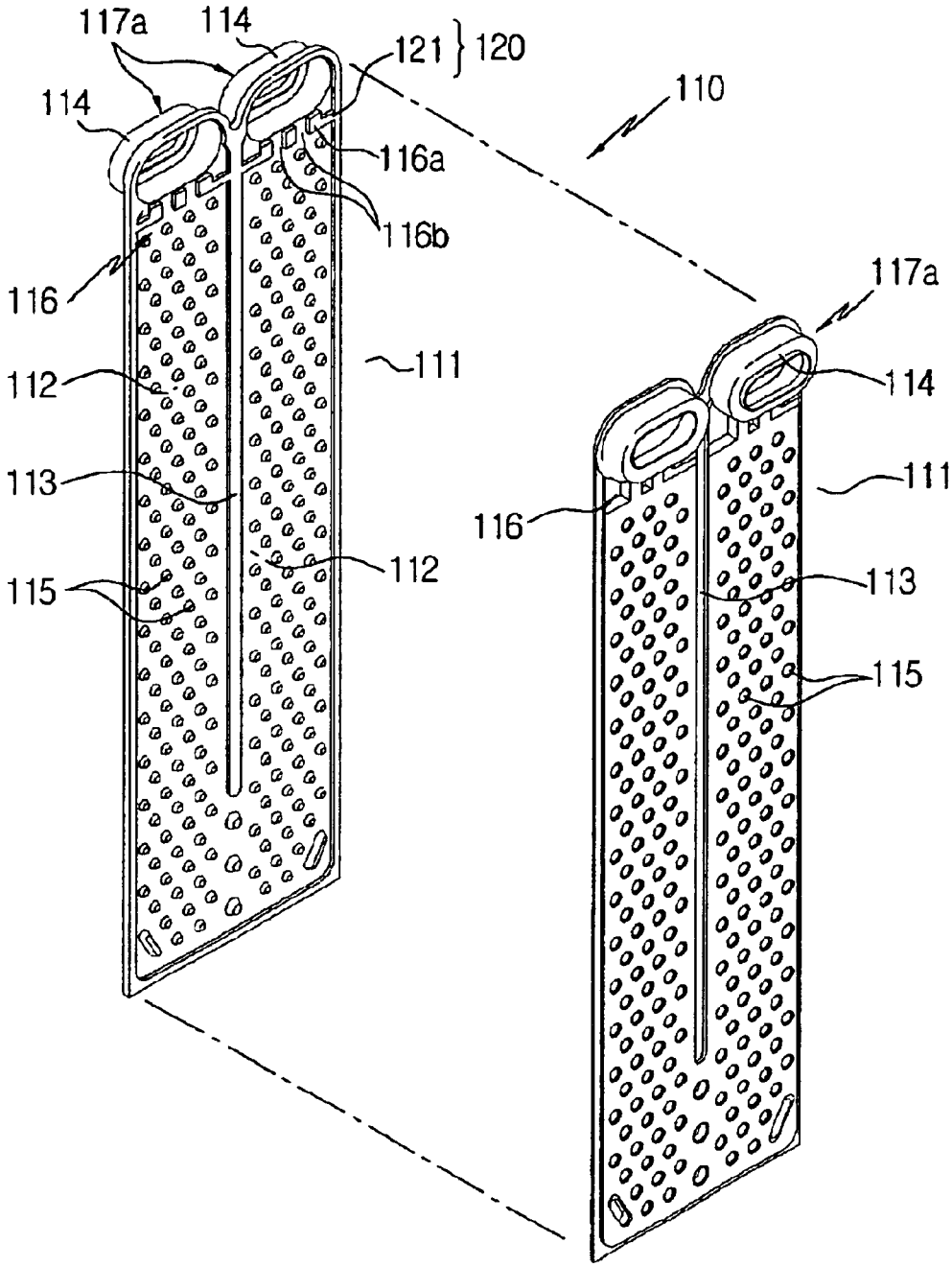
FIG. 10 is a perspective view illustrating separated tubes of the invention.
Figure 11:
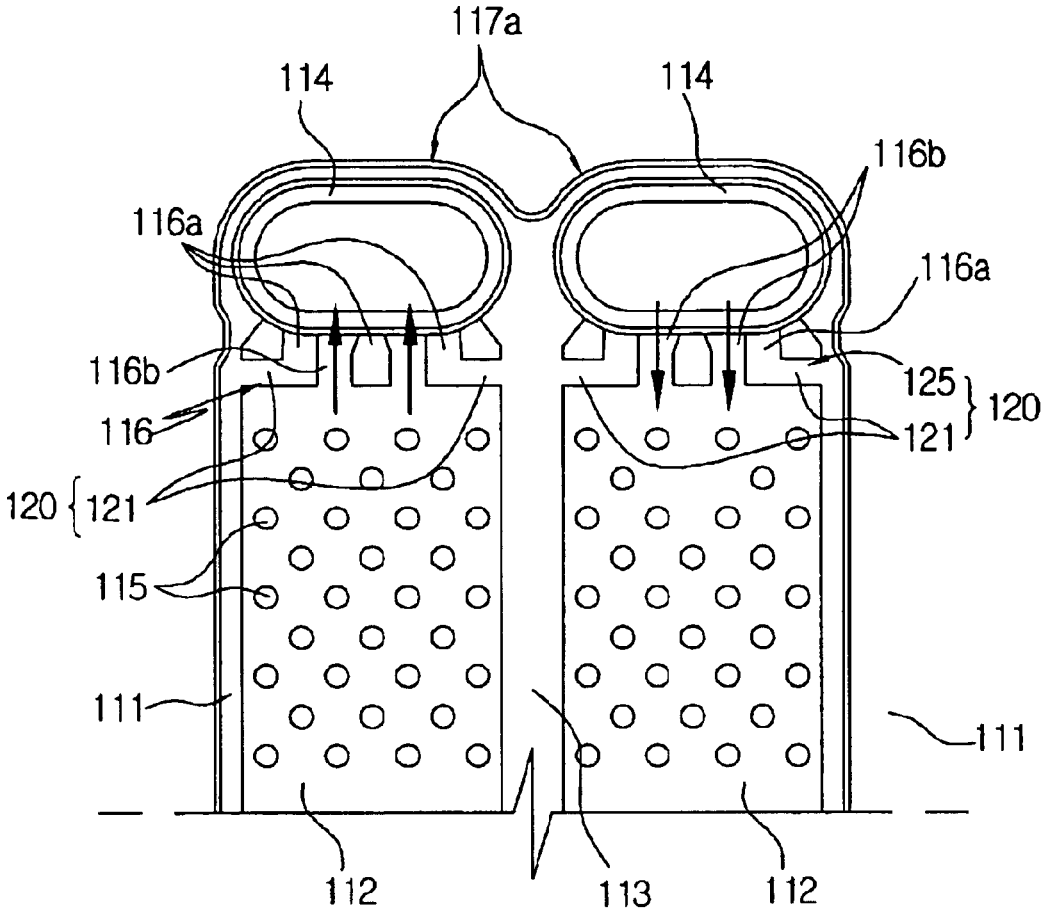
FIG. 11 illustrates a tube of the invention, in which two outermost distribution channels of inlet and outlet side refrigerant distribution sections are closed with closure beads.

FIG. 7 is a perspective view illustrating an evaporator of the invention, FIG. 8 is a perspective view illustrating separated tubes with manifolds of the invention, FIG. 9 illustrates a tube with a manifold of the invention, in which two outermost distribution channels of inlet and outlet side refrigerant distribution sections are closed with closure beads, FIG. 10 is a perspective view illustrating separated tubes of the invention, and FIG. 11 illustrates a tube of the invention, in which two outermost distribution channels of inlet and outlet side refrigerant distribution sections are closed with closure beads.

The evaporator 100 of the invention comprises a pair of tanks 117*a* having parallel cups 114 formed at the upper end, a plurality of tubes 110 and 110*a* each having a refrigerant flow section 112 of a generally U-shaped configuration, which is formed by welding a pair plates 111 with the partitioning bead 113 extended to a predetermined length between a pair of tanks 117*a* and tanks 117 formed at both sides by the welded tanks 117*a*, heat radiator fins 130 interposed between the tubes 110 and 110*a* and two end plates 140 disposed at outermost sides of the tubes 110 and 110*a* to reinforce the tubes 110 and 110*a* and the heat radiator fins 130.

In one of the pair of tanks 117, there is provided a baffle 103 for separating inflow refrigerant from outflow refrigerant.

The baffle 103 divides the tanks 117 and the tubes 110 and 110*a* into an inlet side 101 into which refrigerant is introduced and an outlet side 102 from which refrigerant is discharged.

Manifolds 118 and 118*a* disposed at both sides with respect to the baffle 103 are extended into one of the tanks 117 to communicate with the inside of the tank 117, and coupled with the inlet and outlet pipes 105 and 106 to introduce/discharge refrigerant.

At inlet and outlet sides of the refrigerant flow section 112, there are provided refrigerant distribution sections 116 having a plurality of distribution channels 116*b* which are partitioned by at least one bead 116*a* so that refrigerant can be uniformly distributed and introduced into the refrigerant flow section 112.

A number of beads 115 are formed in the plates 111 at both sides about the partitioning bead 113 along the refrigerant flow section 112, projected via embossment. The beads 115 are regularly arrayed in the shape of gratings along an inclined direction to improve flowing ability of refrigerant and cause turbulent flow to the same.

Further, coupling faces are provided in flanges formed in outer peripheries of the two plates 111, and the two plates 111 are welded together via brazing by contacting the flanges, the partitioning beads 113 and the beads 115 with each other.

In the above evaporator 100, at least one of the tubes 110 and 110*a* includes channel-restricting means 120 provided in inlet and outlet side refrigerant distribution sections 116 in a corresponding one of the refrigerant flow sections 112 to restrict two outermost ones of the distribution channels 116*b* thereof so that refrigerant circulating inside the tanks 117 is uniformly distributed and introduced into the refrigerant flow sections 112 of the tubes 110 and 110*a*.

That is, the tubes 110 and 110*a* of the invention are formed by welding the plates 111 together, in which each of the plates 111 includes a pair of tanks 117*a*, a refrigerant flow section 112 for connecting the tanks 117*a* via a partitioning bead 113 formed between the tanks 117*a*, refrigerant distribution sections 116 provided at inlet and outlet sides of the refrigerant flow section 112 and each having a plurality of distribution channels 116*b* partitioned by at least one bead 116*a*, and channel-restricting means 120 provided in each of the refrigerant distribution sections 116 for restricting outermost ones of the distribution channels 116*b*.

The channel-restricting means 120 preferably comprise closure beads 121 which are formed in two outermost ones of the distribution channels 116*b* of the each refrigerant distribution section 116 to close the distribution channels.

Alternatively, the channel-restricting means 120 may comprise dimple beads formed respectively downstream of two outermost ones of the distribution channels 116*b* so that the dimple beads can replace the closure beads 121 to restrict the distribution channels 116.

In this case, the dimple beads are so constructed to substantially close the two outermost channels.

The dimple beads can be modified into various planar shapes such as a circle, quadrangle, triangle and so on.

Also, the two outermost ones of the distribution channels 116*b* and the refrigerant flow section 112 are configured according to Equation 1 below:

$$0.25 \le \frac{P1 + P2}{W} \le 0.32, \qquad \text{Equation 1}$$

wherein P1 and P2 are respectively the widths of the two outermost ones of the distribution channels 116*b*, and W is the width of the refrigerant flow section 112.

(P1+P2)/W is preferably determined between 0.25 to 0.32. According to experiment, if (P1+P2)/W is less than 0.25, the channel-restricting means 120 provided in the tubes 110 and 110*a* produces insignificant effect. If (P1+P2)/W is larger than 0.32, the flow resistance of refrigerant is enlarged.

The channel-restricting means 120 are equally applied to tubes 110*a* provided with the manifolds 118 and 118*a* as well as the common tubes 110 without the manifolds 118 and 118*a*.

In case of common tubes 110 without the manifolds 118 and 118*a*, the channel-restricting means 120 are preferably provided in the tubes 110 placed at the outlet side 102 about the baffle 103. Particularly in those of the tubes 110 placed at the outlet side 102 about the baffle 103, the channel-restricting means 120 are more preferably provided in the tubes 110 placed between the baffle 103 and the tube 110*a* provided with the outlet side manifold 118*a* (i.e., a region indicated with a dotted line in FIG. 7).

Then, the plates 111 of the invention are provided upstream of an overheated area to increase the quantity of refrigerant flowing into the overheated area thereby improving entire heat-exchanging ability.

That is, after the surface temperature of the evaporator is measured to find any overheated area, the position and the number of the plates 111 are determined according to the degree of overheating to realize the effect of the invention.

As a result, the two outermost ones of the distribution channels 116*b* in each of the refrigerant distribution sections 116 of the tubes 110 are closed by the closure beads 121 or the dimple beads, thereby to reduce the quantity of refrigerant which is directly introduced into the refrigerant flow sections 112 via the distribution channels 116*b* of the refrigerant distribution sections.

Further, when refrigerant is fed into the tanks 117 through the inlet side manifolds 118, this structure reduces the quantity of refrigerant directly flowing into the refrigerant flow sections 112 of the tubes 110*a* with the manifolds 118 so that refrigerant partially flows into the tanks 117. As a result, the quantity of refrigerant is ensured to the extent that refrigerant can be uniformly distributed to the number of tubes 110 arrayed at both sides of the tubes 110*a*.

This can prevent refrigerant from concentrically flowing through a region adjacent to the tube 110*a* having the inlet side manifold 118 so as to avoid creation of a supercooled/overheated area.

Subsequently, refrigerant performs heat exchange while flowing through the tubes 110 and 110*a* in the inlet side 101, and then flows from a "B" section of the tanks 117 to a "C" section of the tanks 117 in order to move toward the outlet side 102.

Herein, according to the invention, the channel-restricting means 120 are provided in the tubes 110 placed between the baffle 103 and the outlet pipe 106 to reduce the quantity of refrigerant directly introduced into the refrigerant flow sections 112 of the respective tubes 110 while refrigerant flows through the tubes 110. Then, because the quantity of refrigerant is ensured to the extent that refrigerant can be uniformly distributed to associated ones of the tubes 110 placed at "C" side ends of the tanks 117, refrigerant can be uniformly distributed through the tubes 110.

In the meantime, the channel-restricting means 120 can be provided not only in the refrigerant distribution sections 116 of the tubes 110 in the outlet side 101 but also in the refrigerant distribution sections 116 of the tubes 110 in the inlet side 101.

In this case, the two outermost distribution channels of the tube 110*a* having the inlet side manifold 118 as well as those of some adjacent tubes 110 at both sides of the tube 110*a* are additionally closed so as to ensure more quantity of refrigerant to the extent that refrigerant fed through the inlet side manifold 118 can be uniformly distributed to the tubes 110 array at both sides. Then, refrigerant can be stably and uniformly distributed and introduced to the tubes 110 at both ends.

Figure 12:
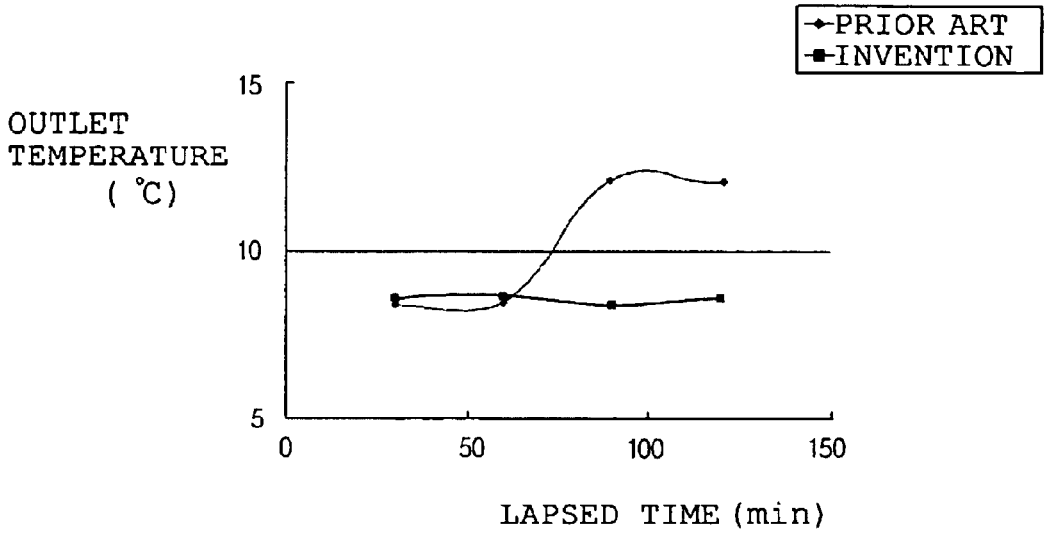
FIG. 12 is a graph showing outlet air temperatures with respect to time of the invention, which is compared with that of the prior art.

FIG. 12 is a graph showing outlet air temperatures with respect to time to compare outlet air temperatures of an inventive example, in which two outermost distribution channels of inlet and outlet side refrigerant distribution sections are closed according to the invention, with outlet air temperatures of a comparative example, in which two outermost distribution channels of an inlet side refrigerant distribution section are closed according to the prior art.

As shown in FIG. 12, while the two examples show similar cooling effects at an initial stage, it can be seen that the temperature of the comparative example is more raised with the passage of time.

This explains that refrigerant flow distribution effect can be obtained to a certain degree even if the two outermost distribution channels 16*b* in the inlet side refrigerant distribution section 16 of the refrigerant flow section 12 are closed but such effect is not sufficient.

That is, the comparative example is raised in temperature according to the passage of time, because refrigerant flow distribution is somewhat ununiform and thus air is discharged without being sufficiently heat exchanged (cooled) owing to icing on the surface of the evaporator 1.

Therefore, as the two outermost distribution channels of the inlet and outlet refrigerant distribution sections 116 of the refrigerant flow sections 112 are closed as set forth above, equally in both of top and bottom tank types of the evaporator 1, that is, regardless of the mounting type of the evaporator 1, this can prevent lopsided refrigerant flow even under the inertial force or gravity through the refrigerant flow sections 112 of the tubes 110 and 110*a* in order to potentially realize excellent cooling efficiency based upon improved refrigerant flow distribution.

Figure 13:
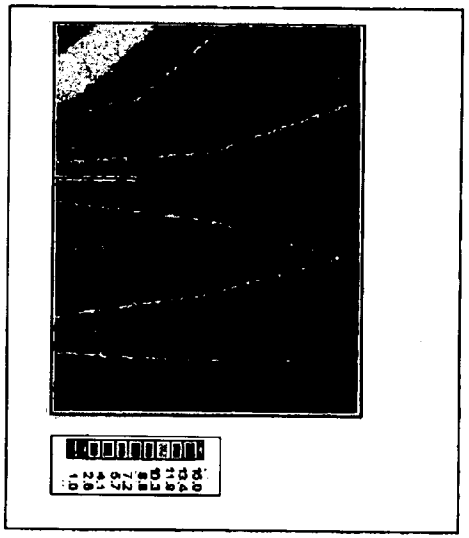
FIG. 13 illustrates surface temperature distribution in an evaporator of the invention, which is compared with that of the prior art.
Figure 13:
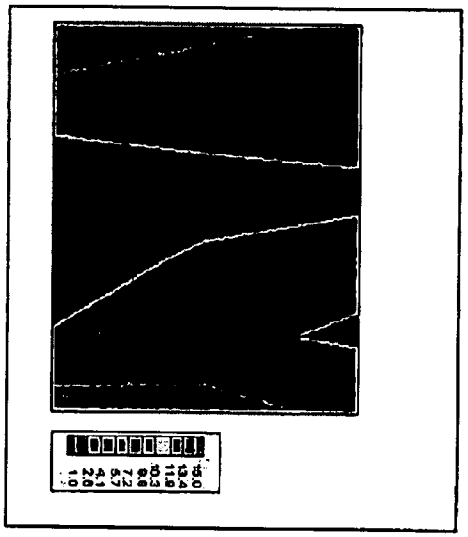

FIG. 13 illustrates surface temperature distributions of evaporators measured along an arrow I in FIG. 7, that is, from behind the evaporators, in which plates of the invention and conventional plates are inspected at an air volume of 200 CMH in which CMH is $m^3$/hour.

As shown in FIG. 13, the conventional evaporator shows that supercooled and overheated areas are created owing to ununiform refrigerant quantity flowing through the tubes so that the evaporator surface temperatures have a large temperature difference of about 10.4° C. between maximum and minimum temperatures.

This means that the temperature of outlet air flowing through the evaporator also becomes ununiform resultantly discomforting a user.

On the contrary, according to the invention, refrigerant uniformly flows through the tubes to improve the flow distribution of refrigerant. It can be understood that the evaporator surface temperatures are distributed relatively uniform, with a temperature difference of about 4.2° C. between maximum and minimum temperatures.

As a result, air of a uniform temperature is introduced into a vehicle room to provide a pleasant environment to passengers as well as improve cooling efficiency.

In the above tubes 110 and 110*a*, while the two outermost ones of the inlet and outlet side refrigerant distribution sections 116 of the refrigerant flow sections 112 are closed by the closure beads 121 or restricted by the dimple beads to allow flow of refrigerant through the distribution channels 116*b*, the distribution channels 116*b* can be formed in the inlet and outlet sides of the refrigerant flow sections 112 and the refrigerant distribution sections 116 can have the distribution channels 116*b* formed by the channel-restricting portions (125) in lateral middle portion of the refrigerant flow sections 112 during formation of the plates 111 for constructing the tubes 110 and 110*a* so that refrigerant flows through the distribution channels 116*b* in lateral middle portion of the respective refrigerant flow sections 112.

As set forth above, the invention has been described about the single tank type evaporator having the structure for closing the two outermost distribution channels in the refrigerant distribution sections 116 of the tubes 110 and 110*a*. However, the invention is not limited to the above structure, but the refrigerant distribution sections 116 for closing the distribution channels 116*b* can be modified variously within the scope of the invention that will be defined by the appended claims. Application of equal structures to a two tank type or four tank type evaporator can expect the same effect as the present invention.

According to the present invention, the two outermost distribution channels of the refrigerant distribution sections in the inlet and outlet sides of the refrigerant flow sections are closed so that refrigerant can be uniformly distributed and introduced into the tanks. As a result, this can prevent any lopsided flow of refrigerant as well as improve flow distribution of refrigerant so that the outlet surface temperature and outlet air temperature of the heat exchanger can be made uniform.

Further, refrigerant is uniformly distributed and introduced into the tubes so as to prevent any supercooled or overheated area without icing.

In addition, air of a uniform temperature is introduced into the vehicle room to provide a pleasant environment to the passengers as well as stabilize an air conditioning system and improve cooling efficiency.

Moreover, the invention can decrease any probability of icing at the surface of the heat exchanger as well as prevent mist owing to actuation of the air conditioning system even at a low flow rate or air volume.

What is claimed is:

1. A laminated heat exchanger comprising:

a number of laminated tubes each formed by coupling a pair of plates;

a refrigerant inlet pipe for feeding refrigerant to the tubes;

a refrigerant outlet pipe for discharging refrigerant out of the tubes; and a number of heat radiator fins interposed between the tubes, wherein at least one of the tubes includes:

a pair of tanks;

a refrigerant flow section for connecting the tanks via a partitioning bead formed between the tanks;

refrigerant distribution sections provided at inlet and outlet sides of the refrigerant flow section and each having a plurality of distribution channels partitioned by at least one bead; and channel-restricting means provided in each of the refrigerant distribution sections, for restricting two outermost ones of the distribution channels.

2. The laminated heat exchanger as set forth in claim 1, wherein the channel-restricting means comprise closure beads which are formed in the two outermost ones of the distribution channels of the each refrigerant distribution section to close the distribution channels.

3. The laminated heat exchanger as set forth in claim 1, wherein the channel-restricting means comprise channel-restricting portions which are formed in two outermost ones of the distribution channels of the each refrigerant distribution section so that the distribution channels are formed at a lateral middle portion of the refrigerant flow section.

4. The laminated heat exchanger as set forth in claim 1, further comprising manifolds which are formed extendably from the tanks of the plates and coupled with the refrigerant inlet and outlet pipes.

5. The laminated heat exchanger as set forth in claim 4, wherein the channel-restricting means comprise closure beads which are formed in the two outermost ones of the distribution channels of the each refrigerant distribution section to close the distribution channels.

6. The laminated heat exchanger as set forth in claim 1, wherein the two outermost ones of the distribution channels and the refrigerant flow section are configured according to Equation 1 below:

$$0.25 \leq \frac{P1 + P2}{W} \leq 0.32, \qquad \text{Equation 1}$$

wherein P1 and P2 are respectively the widths of the two outermost ones of the distribution channels, and W is the width of the refrigerant flow section.

7. The laminated heat exchanger as set forth in claim 1, wherein the channel-restricting means are provided in the tubes which are placed upstream of an overheated area.

8. The laminated heat exchanger as set forth in claim 1, further comprising a baffle provided in one tank of said pair of tanks which is coupled with the tubes in a communicating fashion, the baffle to separate inflow refrigerant from outflow refrigerant.

9. The laminated heat exchanger as set forth in claim 8, wherein the channel-restricting means are provided in the plurality of tubes placed at outlet sides with respect to the baffle.

10. The laminated heat exchanger as set forth in claim 9, wherein the channel-restricting means are provided in corresponding ones of the outlet side tubes placed between the baffle and the outlet pipe.

* * * * *